US009869458B2

(12) United States Patent
Li

(10) Patent No.: US 9,869,458 B2
(45) Date of Patent: Jan. 16, 2018

(54) SPLICING ASSEMBLY AND SPLICING TYPE LED LIGHT

(71) Applicant: Shenzhen Wanjia Lighting Co., Ltd., Shenzhen (CN)

(72) Inventor: Fei Li, Shenzhen (CN)

(73) Assignee: SHENZHEN WANJIA LIGHTING CO., LTD., Shenzhen, Guangdong (CN)

( * ) Notice: Subject to any disclaimer, the term of this patent is extended or adjusted under 35 U.S.C. 154(b) by 214 days.

(21) Appl. No.: 14/921,678

(22) Filed: Oct. 23, 2015

(65) Prior Publication Data

US 2016/0116143 A1 Apr. 28, 2016

(30) Foreign Application Priority Data

Oct. 24, 2014 (CN) ..... 2014 1 0579581

(51) Int. Cl.
*F21V 21/005* (2006.01)
*F21V 15/015* (2006.01)
(Continued)

(52) U.S. Cl.
CPC ..... *F21V 21/005* (2013.01); *F21S 4/20* (2016.01); *F21V 15/015* (2013.01); *F21S 2/00* (2013.01);
(Continued)

(58) Field of Classification Search
None
See application file for complete search history.

(56) References Cited

U.S. PATENT DOCUMENTS 3,086,105 A * 4/1963 Nieder-Westermann ..... F21V 19/008 362/219
6,796,680 B1 * 9/2004 Showers ..... F21V 15/013 362/240
(Continued)

FOREIGN PATENT DOCUMENTS

CN 2895849 5/2007
CN 101509639 8/2009
(Continued)

OTHER PUBLICATIONS

Machine translation of CN103968284A, Aug. 6, 2014.*
Search Report from corresponding Chinese patent application, dated Nov. 8, 2015, 2 pages total.

*Primary Examiner* — Britt D Hanley
(74) *Attorney, Agent, or Firm* — Hamre, Schumann, Mueller & Larson, P.C.

(57) ABSTRACT

The present invention relates to the technical field of LED and discloses a splicing assembly and a splicing type LED light, wherein the splicing assembly is used for splicing a plurality of strip LED lights relative to each other, and includes a plurality of splicing heads and a plurality of connectors, the splicing head is polyhedron shaped, and includes a plurality of outer side faces and a first bottom face and a second bottom face that are set oppositely, the first bottom face is provided with a fixing cavity where end portions of the strip LED lights can be inserted and fixed, the second bottom face and the outer side faces are provided with one or more splicing holes respectively, and each connector has two end portions that can be inserted into the splicing hole and fixed. In the splicing assembly provided by the present invention, the splicing heads can be fixed with the strip LED lights, it is fixed between the splicing heads by connectors, i.e. it may be spliced relative to each other
(Continued)

between the ends of strip LED lights, various structures can be spliced flexibly, the generality of this kind of splicing manner is good, and the operation is convenient. The present invention also provides a splicing type LED light, on the strip LED light mounting with a splicing assembly, it may be spliced directly, and has a good generality.

9 Claims, 11 Drawing Sheets

(51) Int. Cl.

| | |
|---|---|
| ***F21S 4/20*** | (2016.01) |
| *F21V 23/06* | (2006.01) |
| *F21V 23/00* | (2015.01) |
| *F21S 2/00* | (2016.01) |
| *F21S 4/28* | (2016.01) |
| *F21Y 115/10* | (2016.01) |

(52) U.S. Cl.
CPC ..... *F21S 4/28* (2016.01); *F21V 23/001* (2013.01); *F21V 23/06* (2013.01); *F21Y 2115/10* (2016.08)

(56) References Cited

U.S. PATENT DOCUMENTS

| | | | | |
|---|---|---|---|---|
| 2006/0262533 | A1* | 11/2006 | Lin | F21S 2/005 362/249.01 |
| 2007/0047243 | A1* | 3/2007 | Hacker | F21S 2/005 362/382 |
| 2010/0053956 | A1* | 3/2010 | Park | F21K 9/00 362/235 |
| 2010/0135020 | A1* | 6/2010 | Moore | A47F 11/10 362/249.02 |
| 2012/0001554 | A1* | 1/2012 | Leadford | F21S 2/005 315/158 |

FOREIGN PATENT DOCUMENTS

| | | |
|---|---|---|
| CN | 103968284 | 8/2014 |
| CN | 204240105 | 4/2015 |
| WO | 2012/167429 | 12/2012 |

* cited by examiner

SPLICING ASSEMBLY AND SPLICING TYPE LED LIGHT

TECHNICAL FIELD

The present invention relates to the technical field of LED, especially to a splicing assembly and a splicing type LED light.

BACKGROUND

Strip LED lights can be used as strip light sources, and have gradually taken the place of traditional lamp tube structures and appeared in a variety of situations in need of lighting. In these lighting situations, not only a plurality of individual strip LED lights are required, but also the plurality of strip LED lights often need to be combined and spliced depending on specific lighting needs, such as being spliced into an I-shaped form extending linearly, or being spliced into a frame shape with branches, etc.

In the prior art, if a strip LED light is in the splicing type, it needs to employ specially designed components, for example, employing sheet material and a frame as a base, setting a structure that can be fixed with the strip LED light in a corresponding direction on the base, and then splicing; this kind of base and its related fixing structure need to be manufactured according to the actual splicing requirement, and their generality is poor; furthermore, the aid of fasteners such as bolts and others is needed, the operation is also complex, and black block shadows may be generated at the splicing end portions and affect the lighting effect after the splicing has been completed.

BRIEF SUMMARY

Compared with the prior art, in the splicing assembly of the present invention, the fixing cavity of the splicing head itself is nested and fixed on the end portions of the strip LED lights and can be fixed with the end portion; by means of the matching between the connector and a plurality of splicing holes of different planes, the splicing heads are fixed relative to each other, and then the splicing between the end portions of the strip LED lights are completed; the splicing manners of I-shaped, cross-shaped, double line-shaped, and others between the strip LED lights can be completed by combinations, the splicing operation is simple, does not need to be customized according to the splicing requirements specially, and has a good generality.

The present invention also provides a splicing type LED light, which includes strip LED lights and a splicing assembly mentioned above, wherein the splicing heads are mounted at both ends of each of the strip LED lights.

DETAILED DESCRIPTION OF THE PREFERRED EMBODIMENT

To make the objects, technical schemes and advantages of the present invention be more apparent, the present invention will be described below in further detail in combination with the accompanying drawings and embodiments. It should be understood that the specific embodiments described herein are only used to explain the present invention and are not intended to limit the present invention.

Hereinafter, the implementation of the present embodiment will be described in detail in combination with the specific accompanying drawings.

Figure 1:
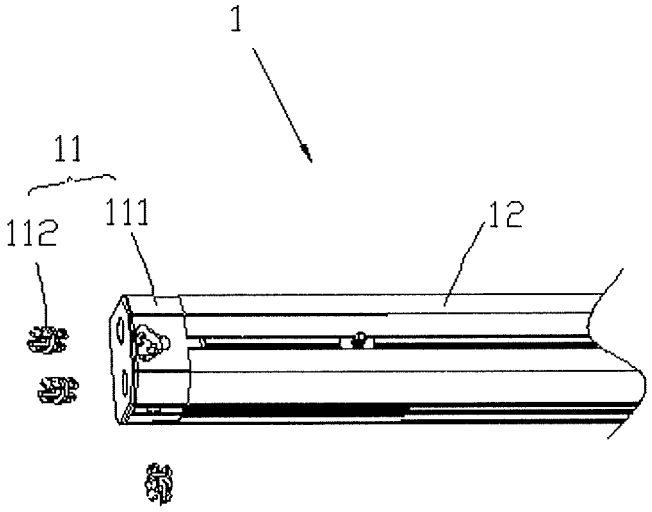
FIG. 1 is a matching schematic view of the splicing assembly and strip LED lights provided by an embodiment of the present invention.
Figure 2:
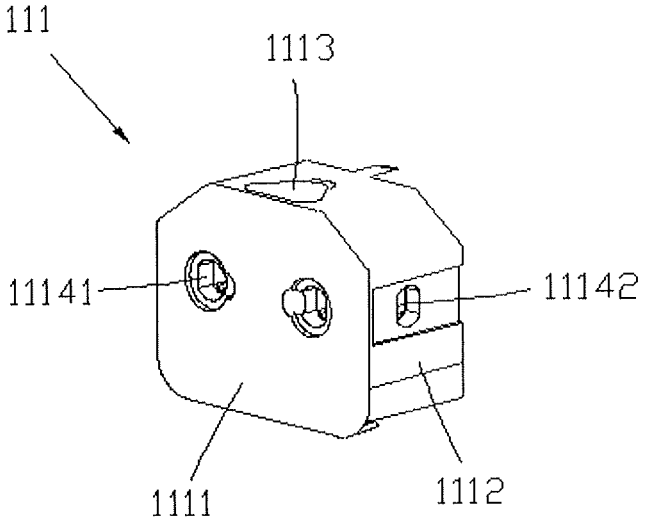
FIG. 2 is a structural schematic view of a splicing head of the embodiment of the present invention.
Figure 3:
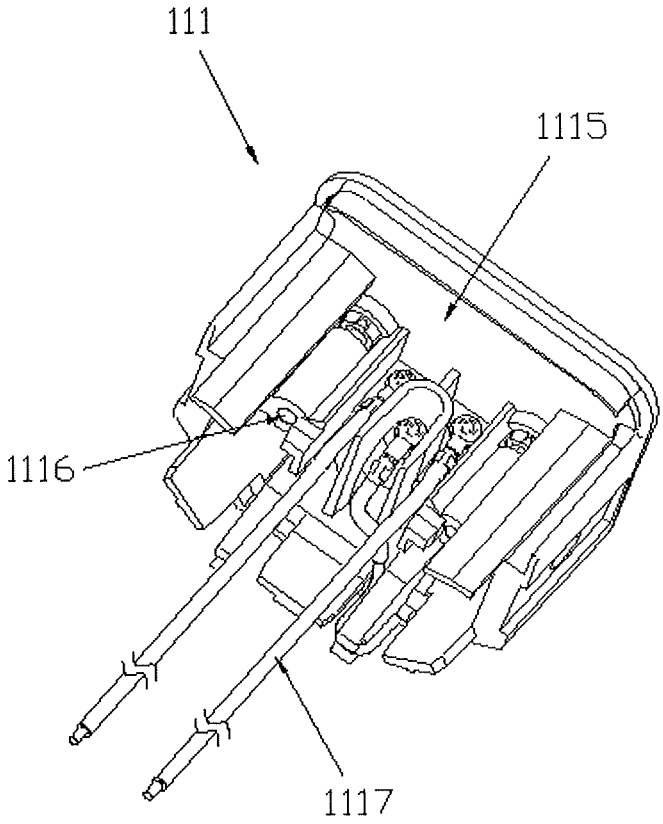
FIG. 3 is a schematic view of an internal fixing cavity of the splicing head of the embodiment of the present invention.
Figure 4:
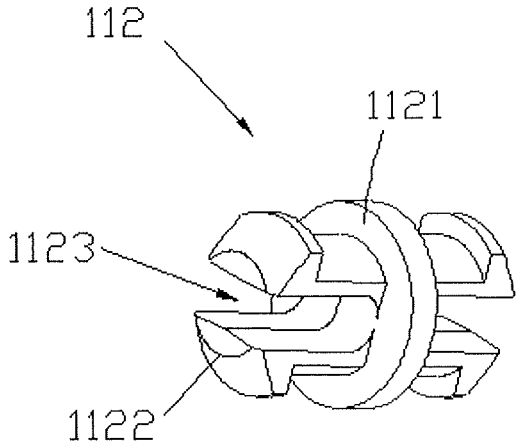
FIG. 4 is a structural schematic view of a connector of the embodiment of the present invention.

As shown in FIGS. 1-3, a splicing assembly 11 includes a plurality of splicing heads 111 and a plurality of connectors 112, the splicing heads 111 are mounted on end portions of the strip LED lights 12, and each connector 112 can fix the two splicing heads 111 with each other. The splicing head 111 is a polyhedral-shaped member, and comprises a plurality of outer side faces and a first bottom face (not labeled) and a second bottom face 111 that are set oppositely; the first bottom face is provided with a fixing cavity 1115, the end portions of the strip LED lights 12 can be inserted into the fixing cavity 115 and mounted and fixed at the splicing head 111; the second bottom face 1111 and the outer side face are provided with one or more splicing holes, both end portions of the connector 112 can be inserted into and fixed with the splicing holes.

When splicing the strip LED lights 12, firstly, the end portions of the strip LED lights 12 in need of splicing relative to each other are inserted into the splicing head 111 and fixed, and then a connector 112 between the two splicing heads 111 in need of splicing is inserted into respective splicing holes of the two splicing heads 111, such that the two splicing head 111 are spliced and fixed relative to each other, and thus the end portions of the two strip LED lights 12 are spliced together. Since the shape of the splicing head 111 is polyhedral, the second bottom face 1111 of the splicing head 11 is perpendicular to the extending direction of the strip LED light 12 itself, an I-shaped splicing extending linearly can be realized, i.e. as the manner illustrated in FIG. 5; if the outer side face of the splicing head 11 is parallel to the extending direction of the strip LED light 12 itself, an L-shaped splicing extending laterally can be realized, as the manner illustrated in FIG. 6.

Figure 8:
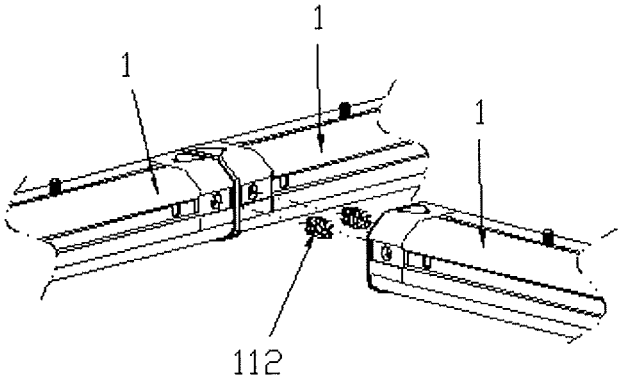
FIG. 8 is a schematic view of the T-shaped connection of the splicing type LED light provided by the embodiment of the present invention.
Figure 10:
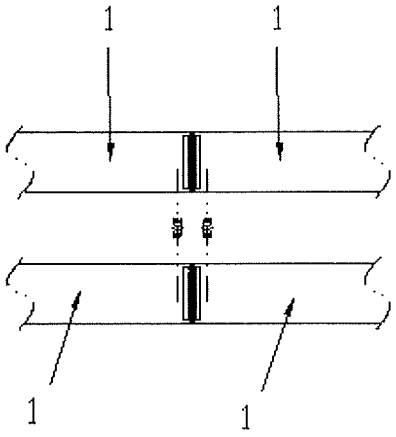
FIG. 10 is a schematic view of a double line-shaped connection of the splicing type LED light provided by the embodiment of the present invention.
Figure 11:
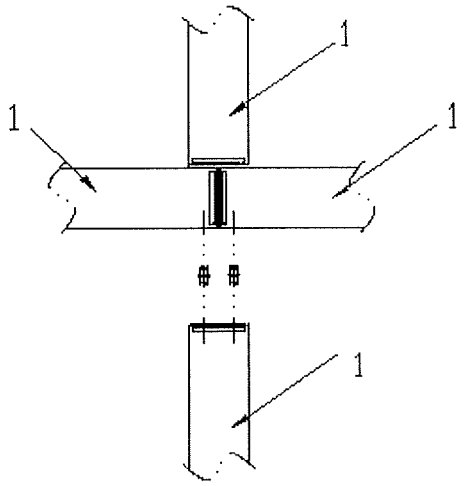
FIG. 11 is a schematic view of a cross-shaped connection of the splicing type LED light provided by the embodiment of the present invention.

When using the splicing assembly 11 of the present embodiment to splice the strip LED lights, it just requires to fix the splicing head 111 to the strip LED light firstly, and then after align a predetermined direction, insert the connector 112 correspondingly, which are easy to operate. Combined with the two kinds of basic splicing manners of I-shaped splicing and L-shaped splicing mentioned above, a T-shaped splicing applied to three strip LED lights as shown in FIG. 8, a double line-shaped splicing applied to two or four strip LED lights as shown in FIG. 10, and a cross-shaped splicing applied to four strip LED lights as shown in FIG. 11 can be combined, these derived splicing manners can splice and combine a plurality of strip LED lights into bar type or various frame type structures, the splicing manner can be selected flexibly, without the need of designing structures for specific splicing schemes especially, and has a good generality.

Figure 6:
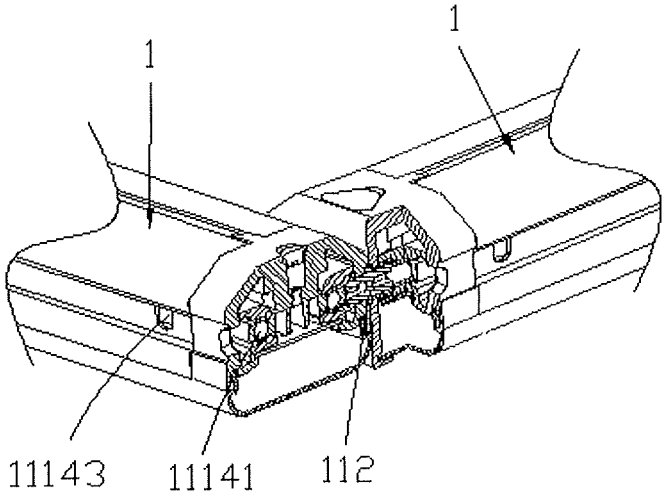
FIG. 6 is a cross sectional schematic view of a joint of a T-shaped connection of the splicing type LED light provided by the embodiment of the present invention.
Figure 7:
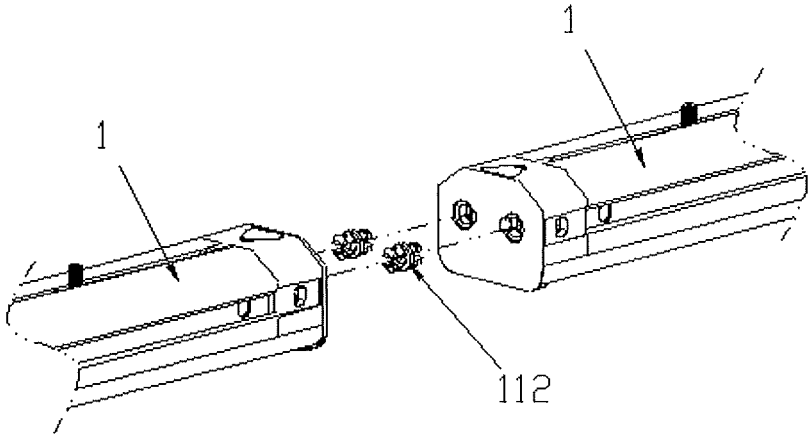
FIG. 7 is a schematic view of the I-shaped connection of the splicing type LED light provided by the embodiment of the present invention.

As shown in FIG. 2 and FIG. 6, the outer side face of the splicing head 111 includes two relatively parallel fixing side faces 1112, each fixing side face 1112 is provided with at least one splicing hole. As shown in FIG. 11, when both the two fixing side faces 1112 of a splicing head 111 of one strip LED lights 12 are spliced with one strip LED light 12, since the fixing side faces 1112 are opposite to each other and perpendicular to the second bottom face 1111, the three strip LED lights 12 spliced together are now on the same plane. When employing the splicing head 111 to splice, any splicing combination can ensure that all strip LED lights also located on the same plane. If splicing holes are set on the side faces at two sides not opposed, the structures of a plurality of completely spliced strip LED lights 12 with branches will be scattered, not only the lighting effect is affected, but also it is difficult to suspendingly mount and fix.

As shown in FIG. 2, two bottom splicing holes 11141 are set on the second bottom surface 1111, and a distance between the central axes of the two holes 11141 is a. One side face splicing hole 11142 is set on each fixing side face 1112, and a distance between an axis of the side face splicing hole 11142 and the second bottom face 1111 is b, a=2b. When employing the T-shaped splicing scheme as shown in FIG. 8, the two strip LED lights 12 relying on the second bottom face 111 to splice are spliced completely, and the two side face splicing holes 11142 of both fixing side faces 1112 are on the same plane, since a=2b, the two bottom face splicing holes 11141 on the second bottom face can be aligned with the two bottom face splicing holes 11141 on the second bottom face of another splicing head 111 aligning one by one and spliced directly, i.e., the three strip LED lights 12 end portions are spliced together to achieve a better fixing effect of splicing, the splicing relationship between each other is more reliable, and the defections such as interferences or remained gaps that affect the splicing effects will not occur.

Figure 5:
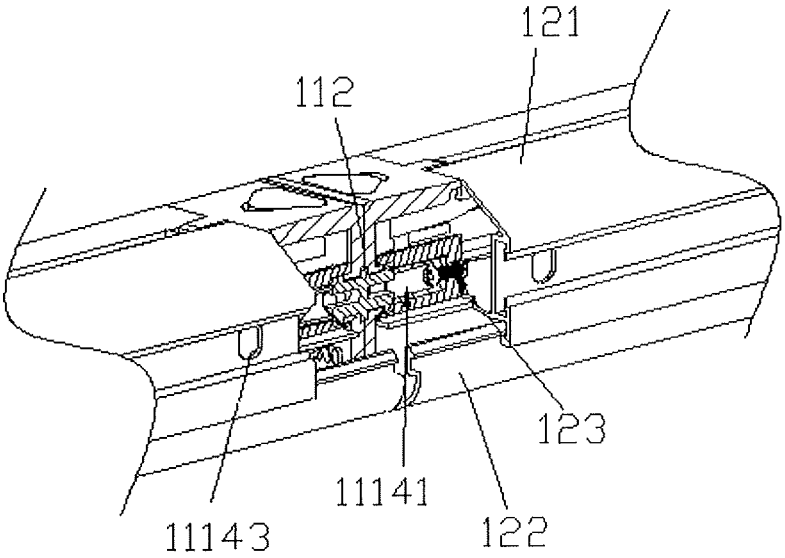
FIG. 5 is a cross sectional schematic view of a joint of an I-shaped connection of the splicing type LED light provided by the embodiment of the present invention.

The internal structure of the two side face splicing holes 11142 and the bottom face splicing holes 11141 are the same except their positions, and the bottom face splicing hole 11141 is taken as an example to explain their structures; as shown in FIG. 5 and FIG. 6, a concave ring (not labeled) is set in the internal sidewall of each bottom side face 11141 circumferentially, the concave ring is a structure that annularly recessed along its internal sidewall, each end portion of the connector 112 protrudes to form a projection 1122; after the end portion has been inserted into a bottom face splicing hole 11141, the projection 1122 can be snapped into and fixed in the concave ring, so that this end portion of the connector 112 is fixed inside the bottom face splicing hole 11141. The connector 112 may also be fixed with the bottom splicing holes 11141 in other ways, such as setting cooperating threads between both.

In order to facilitate the insertion into the bottom face splicing hole 11141, the end of the projection 1122 is set into a conical shape, and the middle portion thereof is provided with a horizontal deformation through groove 1123; when being inserted, the end of the conical projection 1122 is subjected to a pressing force from the bottom face splicing hole 11141, and thus deforms and reduces along the deformation through groove 1123; after the projection 1122 enters the bottom face splicing hole 11141 and the concave ring position, it is released and rebounds along the deformation through groove 1123, thereby snapping and locking into the concave ring.

As shown in FIGS. 5 and 6, the area on the splicing head 111 being provided with the bottom face splicing holes 11141 is further provided with a snapping connection cavity (not shown) defined along the outer edge of the bottom face splicing hole 11141, a middle portion of connector 112 protrudes to form a snapping connection ring 1121, the shape of the snapping connection ring 1121 corresponds to the snapping connection cavity, and the thickness of the snapping connection ring 1121 is less than or equal to twice of the depth of the snapping connection cavity. After one end of the connector 112 has been snapped into the bottom face splicing hole 11141, the snapping connection ring 1121 enters the snapping connection cavity and is pressed against the outer edge of the bottom face splicing hole 11141, so that the end of the connector 112 could not continue to extend, thereby functioning to locate and limit. When the two splicing head 111 are spliced together, the corresponding snapping connection cavity are merged into a enclosed chamber, since the thickness of the snapping connection ring 1121 is less than or equal to twice of the depth of the snapping connection cavity, the snapping connection ring 1121 can be completely located in this chamber, without affecting the fitness between the corresponding planes of splicing heads 111.

As shown in FIGS. 2 and 3, the outer side face of the splicing head 111 is also provided with an electrical socket 1113, a power line 1117 is set inside the fixing cavity 1115, and the power line 1117 and electrical socket 1113 is electrically connected with each other. After the strip LED light 12 has been inserted into the fixing cavity 1115, it may be connected with the electrical socket 1113 by the input line 1117; after an external power supply line has been plugged into the electrical socket 1113 through a corresponding plug, the strip LED lights 12 can be supplied with electricity.

The present invention also provides a splicing type LED light 1, which includes a plurality of strip LED lights 12 and a splicing assembly 11 mentioned above, both ends of each strip LED light 12 is mounted with a splicing head 111. When in need of splicing, the splicing type LED lights 1 can be spliced according to the manner described above directly.

Figure 9:
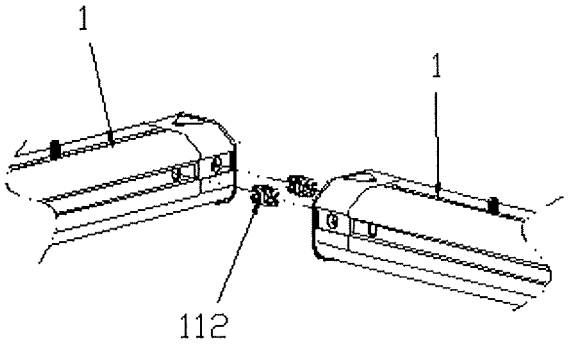
FIG. 9 is a schematic view of an L-shaped connection of the splicing type LED light provided by the embodiment of the present invention.

As shown in FIG. 5, each strip LED light 12 includes a lamp tube 122 that can emit light and an upper shell 121, the splicing holes also include an upper shell splicing hole 11143 set on the upper shell 121 and on a portion of the splicing head 111, a distance between the axes of the upper shell splicing hole 11143 and another upper shell splicing hole 11143 set on the splicing head 111 fixing side face 1112 is c, c=a=2b. In the L-shaped splicing scheme shown in FIG. 9, two splicing type LED lights 1 is perpendicularly spliced directly, in addition to the connector 112 connected between two splicing heads 111, there is further one connector 112 connected between the upper shell 121 and splicing head 111 to ensure that even when only two splicing type LED lights 1 are spliced to each other, the L-shaped splicing assembly can still have a better splicing stability.

As shown in FIGS. 3 and 5, the bottom end of the bottom splicing holes 11141 is provided with a fixing hole 1116, the hole diameter of the fixing hole 1116 is smaller than that of the bottom face splicing hole 11141, and the fixing hole 1116 pass through the splicing head 111. A threaded hole (not labeled) is formed at the corresponding position of the end portion of the upper shell 121. After the splicing head 111 has been mounted to the strip LED lights 12, the bolt 123 is inserted from the bottom face splicing hole 11141, the bolt 123 passes through the fixing hole 1116, of which the bolt head abuts against the bottom end of bottom face splicing hole 11141, and finally the screw rod thereof is screwed into the threaded hole, thereby fixing the splicing head 111 and the strip LED lights 12 together. This fixing manner is not only firmly fixed, but also reduces the number of holes on the surface of splicing head 111 by means of taking the bottom face splicing hole 11141 as the hole for the bolt 123 to run through. To prevent dust from entering the splicing hole 11141 on the second bottom face 1111, a dust proof cover may also be set on the outside of the bottom face splicing hole 11141, and the dust proof cover can be removed when splicing is needed.

As shown in FIG. 5, in this embodiment, the two ends of the lamp tube 122 of each strip LED light 122 exceed the upper shell 121, and extend into the fixing cavity 1115 of said splicing head 111; the splicing head 111 is a translucent member. After the splicing has been completed and the light is on, not only the exposed portion of the lamp tube 122 emits light, but also the lamp tube 122 inside the fixing cavity 1115 emits light too, and the light passes through the translucent splicing head 111, so that the splicing head 111 portion would not form any black block shadow, and thus the overall lighting effect is superior.

The invention claimed is:

1. A splicing assembly for splicing a plurality of strip LED lights relative to each other, comprising a plurality of splicing heads and a plurality of connectors; wherein, said splicing head is polyhedron shaped and includes a plurality of outer side faces and a first bottom face and a second bottom face that are set oppositely, said first bottom face is provided with a fixing cavity where said strip LED lights end portion can be inserted and fixed, said second bottom face and said outer side faces are provided with one or more splicing holes respectively, and each of said connectors has two end portions that can be inserted into and fixed in said splicing hole;

wherein the outer side faces of the splicing head include two relatively parallel fixing side faces, and the splicing holes are provided on the fixing side faces respectively.

2. The splicing assembly of claim 1, wherein each of the splicing holes includes two bottom face splicing holes set on the second bottom side face, and one side face splicing hole set on each fixing side face.

3. The splicing assembly of claim 1, wherein the internal sidewall of the splicing hole is provided with a concave ring circumferentially, each of the end portions of the connector protrudes to form a projection that can be snapped into the concave ring, an end of projection is conical to facilitate the insertion into the splicing hole, and a middle portion of the projection is provided with a deformation through groove configured for facilitating deformation and reducing of the end of the projection.

4. The splicing assembly of claim 1, wherein, a snapping connection cavity is set at the edge the splicing head that is provided with the splicing holes, a middle portion of the connector protrudes to form a snapping connection ring for abutting against the bottom face of the snapping connection cavity, the thickness of the snapping connection ring is less than or equal to twice of the depth of the snapping connection cavity.

5. The splicing assembly of claim 1, wherein each outer side face of the splicing head is also provided with an electrical socket for external electrical connection, a power line configured for electrically connecting with the strip LED lights is set inside the fixing cavity, and the power line is electrically connected to the electrical socket.

6. A splicing type LED light, comprising at least one strip LED light and a splicing assembly according to claim 1, and the splicing head are mounted at both ends of each strip LED light.

7. The splicing type LED light of claim 6, wherein the strip LED lights includes a lamp tube that can emit light and an upper shell, and the splicing hole also includes an upper shell splicing hole set on a part of the upper shell abutting the splicing head portion.

8. The splicing type LED lights of claim 7, wherein a fixing hole with a hole diameter that is less than a hole diameter of the splicing hole is penetratingly set on the bottom end of the bottom face splicing hole, a threaded hole is provided at the corresponding position of the upper shell end portion, and the splicing head and the strip LED light can be fixed relative to each other by a bolt which can pass through the fixing hole and screw into the threaded hole.

9. The splicing type LED light of claim 7, wherein two ends of the lamp tube extend into the fixing cavity of the splicing head, and the splicing head is a translucent.

* * * * *